US008113450B2

(12) United States Patent
Shiina et al.

(10) Patent No.: US 8,113,450 B2
(45) Date of Patent: Feb. 14, 2012

(54) PULVERIZATION/DISPERSION PROCESSING SYSTEM

(75) Inventors: Satoshi Shiina, Tochigi (JP); Osamu Ishikawa, Tochigi (JP); Hiroaki Kezuka, Tochigi (JP)

(73) Assignee: Nippon Coke & Engineering Co., Ltd., Tokyo (JP)

( * ) Notice: Subject to any disclaimer, the term of this patent is extended or adjusted under 35 U.S.C. 154(b) by 257 days.

(21) Appl. No.: 12/450,726

(22) PCT Filed: Apr. 9, 2008

(86) PCT No.: PCT/JP2008/057004

§ 371 (c)(1),
(2), (4) Date: Oct. 9, 2009

(87) PCT Pub. No.: WO2008/126859

PCT Pub. Date: Oct. 23, 2008

(65) Prior Publication Data

US 2010/0072312 A1 Mar. 25, 2010

(30) Foreign Application Priority Data

Apr. 11, 2007 (JP) ..... 2007-103873

(51) Int. Cl.
*B02C 19/00* (2006.01)

(52) U.S. Cl. ..... 241/33; 241/80; 241/172

(58) Field of Classification Search ..... 241/33, 241/37, 80, 97, 172
See application file for complete search history.

(56) References Cited

U.S. PATENT DOCUMENTS

| | | | | |
|---|---|---|---|---|
| 5,624,080 | A * | 4/1997 | Stehr et al. | 241/80 |
| 6,719,610 | B2 * | 4/2004 | Chou et al. | 451/28 |
| 2005/0001079 | A1 * | 1/2005 | Ford et al. | 241/18 |

FOREIGN PATENT DOCUMENTS

| | | | |
|---|---|---|---|
| JP | 10-78684 | A | 3/1998 |
| JP | 2004-98416 | A | 4/2004 |
| JP | 2004-516468 | A | 6/2004 |
| JP | 2005-125192 | A | 5/2005 |

* cited by examiner

*Primary Examiner* — Faye Francis
(74) *Attorney, Agent, or Firm* — Bacon & Thomas, PLLC

(57) ABSTRACT

In a pulverization/dispersion processing system using a medium agitating type wet pulverization/dispersion machine, a system capable of judging the progress of pulverization/dispersion processing successively and objectively during the pulverization/dispersion processing is provided.

A pulverization/dispersion processing system 10 including a medium agitating type wet pulverization/dispersion machine 20, a holding tank 40 of a material to be processed, a circulating pump 30, and circulating lines 50 connecting these components to each other is equipped with a particle size distribution measuring instrument and/or a zeta potential measuring instrument 60 in one of the circulating lines 50. These measuring instruments 60 perform measurement by means of an ultrasonic wave, and can use an ultrasonic attenuation method or an electronkinetic sonic amplitude method.

13 Claims, 4 Drawing Sheets

(Prior Art)

PULVERIZATION/DISPERSION PROCESSING SYSTEM

TECHNICAL FIELD

The present invention relates to a pulverization/dispersion processing system using a medium agitating type wet pulverization/dispersion machine, and more particularly to a pulverization/dispersion processing system capable of checking the progress of pulverization/dispersion processing successively and objectively.

BACKGROUND ART

A medium agitating type wet pulverization/dispersion machine is widely used for pulverization processing and dispersion processing in the fields of inks, paints, ceramics, metals, inorganic substances, organic substances, magnetic substances, pigments, pharmaceuticals, and the like. The particle diameters after processing are frequently 1 μm or less, and the materials are frequently in high concentrations or in high viscosity. There are many kinds of medium agitating type wet pulverization/dispersion machines, and Patent Document 1 describes one example thereof and a pulverization/dispersion processing system using the example.

As shown in FIG. 7, the processing system 110 described in Patent Document 1 includes a medium agitating type wet pulverization/dispersion machine 120, a holding tank 140 of a material to be processed, a circulating pump 130, and circulating lines 150 connecting the above components to each other. The material to be processed that has been put in the holding tank 140 is circulated through the circulating lines 150 by the circulating pump 130, and is repeatedly subjected to pulverization/dispersion processing by the medium agitating type wet pulverization/dispersion machine 120. As a result, the pulverization/dispersion processing progresses to the whole material to be processed in the system, and the miniaturization of particles gradually progresses. Accordingly, it is desirable to obtain the information enabling the successive and objectively judgment of the progress of the pulverization/dispersion processing.

The information that is most desirable for the judgment of the progress of the pulverization/dispersion processing is the particle size distribution of the material to be processed. A laser diffractometry is used for the measurement of a particle size distribution in many cases. For example, Patent Document 2 describes a method of measuring powdered coal to be used in a high concentration with a particle size distribution measuring apparatus of a laser diffractometry system. Patent Document 2 describes a particle size distribution measuring apparatus capable of continuously measuring the particle size distribution by attenuating high concentration particles in an air current with a carrier gas.

Moreover, Patent Document 3 describes an example of using a particle size measuring machine of the laser diffractometry system in wet sand pulverizing equipment pulverizing original sand with a wet pulverizer. That is, it is described that the particle size of sand (particle diameter: 5 mm or less) after the pulverization of the original sand is measured, and the supply quantity of the original sand to be supplied to the wet pulverizer is controlled on the basis of the result of the measurement.

However, because the conventional methods use optical methods, samples must be transparent, and it is necessary to dilute the samples to the degree of about 10 mg/L generally. On the other hand, it is unable to dilute the concentration of the material to be processed for measurement in the pulverization/dispersion processing system shown in FIG. 7. Moreover, even if a part of the material to be processed is sampled for measuring the material, it is difficult to measure the sampled part in a short time. Consequently, it is difficult to judge the progress of the pulverization/dispersion processing successively and objectively in a pulverization/dispersion processing system using a medium agitating type wet pulverization/dispersion machine.

Patent Document 1: Japanese Patent Application Laid-Open Publication No 2005-125192

Patent Document 2: Japanese Patent Application Laid-Open Publication No. 2005-241480

Patent Document 3: Japanese Patent Application Laid-Open Publication No. 2000-312837

DISCLOSURE OF THE INVENTION

Problems to be Solved by the Invention

Accordingly, the present invention aims at providing a pulverization/dispersion processing system capable of judging the progress of pulverization/dispersion processing successively and objectively in a pulverization/dispersion processing system using a medium agitating type wet pulverization/dispersion machine. Then, a system realizable without causing any changes of the concentration and the like of a material to be processed is desirable. Moreover, a system capable of presenting information in a short period without requiring any human hands is desirable.

Means for Solving the Problems

The inventors of the present invention focused on a particle size distribution and zeta potential as means for judging the progress of pulverization/dispersion processing, and zealously researched the particle size distribution and the zeta potential. As a result, the inventors found that a measuring method measuring the particle size distribution and the zeta potential by means of an ultrasonic wave enabled the measurement of the particle size distribution and the zeta potential even under the condition of a high concentration by improving the measuring method. That is, the inventors found that a major cause of errors of the conventional measuring method of a particle size distribution and zeta potential performing the measurement by means of an ultrasonic wave was air bubbles included in a material to be processed, and that the solutions of the aforesaid problems could be attained by preventing the generation of the air bubble.

In order to solve the problems mentioned above, the pulverization/dispersion processing system according to claim 1 of the present invention is a pulverization/dispersion processing system including a medium agitating type wet pulverization/dispersion machine, a holding tank of a material to be processed, a circulating pump, and a circulating line connecting these components to each other, the system adopting means including: a particle size distribution measuring instrument and/or a zeta potential measuring instrument in the circulating line on an entrance side of the medium agitating type wet pulverization/dispersion machine. Moreover, the pulverization/dispersion processing system according to claim 2 of the present invention is a pulverization/dispersion processing system including a medium agitating type wet pulverization/dispersion machine, a holding tank of a material to be processed, a circulating pump, and a circulating line connecting these components to each other, the system adopting means including: a sampling pump and a sampling circulating line apart from the circulating pump and the circulating line, wherein a particle size distribution measuring instrument and/or a zeta potential measuring instrument are provided in the sampling circulating line.

Moreover, the pulverization/dispersion processing system according to claim 3 of the present invention is the pulverization/dispersion processing system according to claim 1 or 2, the system adopting means in which the particle size distribution measuring instrument and/or the zeta potential measuring instrument perform measurement by means of an ultrasonic wave. Moreover, the pulverization/dispersion processing system according to claim 4 of the present invention is the pulverization/dispersion processing system according to claim 3, the system adopting means in which the particle size distribution measuring instrument performs the measurement by means of an ultrasonic attenuation method. Moreover, the pulverization/dispersion processing system according to claim 5 of the present invention is the pulverization/dispersion processing system according to claim 3, the system adopting means in which the particle size distribution measuring instrument and the zeta potential measuring instrument perform the measurement by means of an electronkinetic sonic amplitude method. Moreover, the pulverization/dispersion processing system according to claim 6 of the present invention is the pulverization/dispersion processing system according to claim 3, the system adopting means in which the particle size distribution measuring instrument performs the measurement by means of an ultrasonic attenuation method and an electronkinetic sonic amplitude method.

EFFECTS OF THE INVENTION

The pulverization/dispersion processing systems of the present invention can judge the progress of pulverization/dispersion processing successively and objectively by the configurations mentioned above. That is, the pulverization/dispersion processing systems can present the particle size distribution and the zeta potential of the material to be processed in a short period during the pulverization/dispersion processing. As a result, it is possible to check that the scheduled pulverization/dispersion processing has been performed surely every performance of the pulverization/dispersion processing to end the processing. Consequently, there is no possibility of the production of any rejected articles, and stable qualities can be always secured.

EXPLANATIONS OF MARKS

Figure 1:
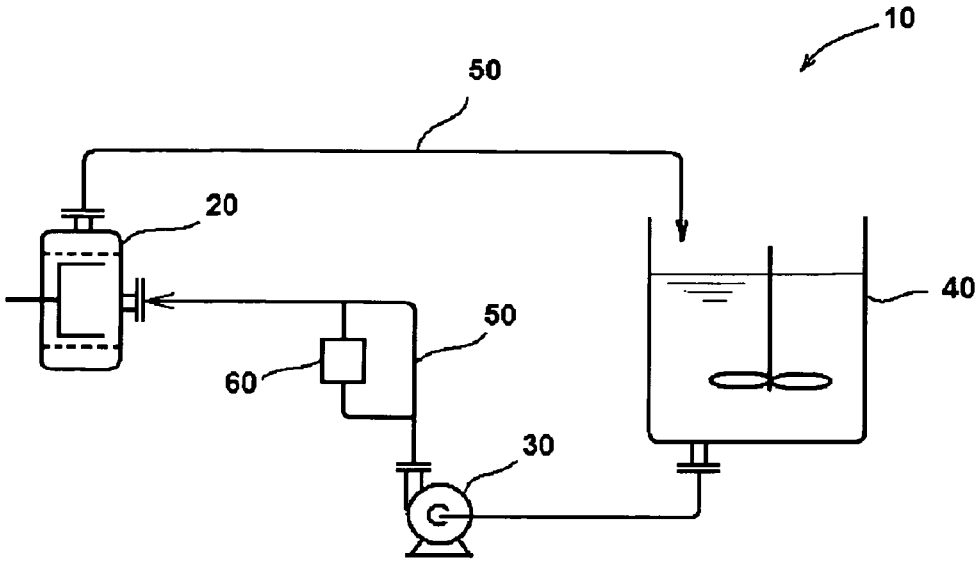
FIG. 1 is a schematic explanatory view showing a concrete example of the pulverization/dispersion processing system of the present invention.

10, 11, 110: pulverization/dispersion processing system
20, 21, 22, 120: medium agitating type wet pulverization/dispersion machine
30, 130: circulating pump
31: sampling pump
40, 140: holding tank
50, 150: circulating line
51: sampling circulating line
60: measuring instrument
70, 80: pulverization container
71, 81: supply port
72, 82: exhaust port
73, 83: agitating member
74, 84: separator
75, 85: driving shaft

BEST MODE FOR CARRYING OUT THE INVENTION

Concrete embodiments of the present invention will be described with reference to FIGS. 1 and 2.

That is, a pulverization/dispersion processing system 10 of the present invention shown in FIG. 1 includes a medium agitating type wet pulverization/dispersion machine 20, a holding tank 40 of a material to be processed, a circulating pump 30, and circulating lines 50 connecting these components to each other. A particle size distribution measuring instrument and/or zeta potential measuring instrument 60 is provided in one of the circulating lines 50.

Here, the generation of air bubbles can be prevented by placing the position of the measuring instrument 60 at a position other than the exit side of the medium agitating type wet pulverization/dispersion machine 20. That is, the position of the measuring instrument 60 is adapted to be placed in the circulating line on the entrance side of the medium agitating type wet pulverization/dispersion machine 20. If the flow rate in the circulating lines 50 is comparatively large, then a bypass line is formed in a part of the circulating lines 50 as shown in FIG. 1, and the measuring instrument 60 is attached there. Moreover, if the flow rate in the circulating lines 50 is comparatively small, then it is also possible to attach the measuring instrument 60 directly to the circulating line 50.

Figure 2:
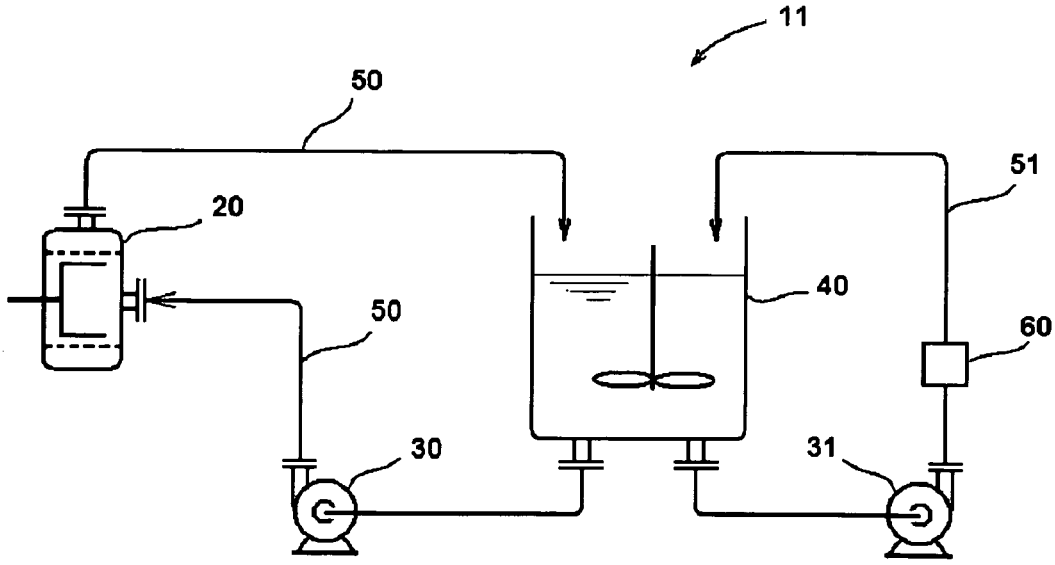
FIG. 2 is a schematic explanatory view showing another example of the pulverization/dispersion processing system of the present invention.

Moreover, a pulverization/dispersion processing system 11 of the present invention shown in FIG. 2 includes the medium agitating type wet pulverization/dispersion machine 20, the holding tank 40 of the material to be processed, the circulating pump 30, and the circulating lines 50 connecting these components to each other. Furthermore, the pulverization/dispersion processing system 11 includes a sampling pump 31 and a sampling circulating line 51 apart from the circulating pump 30 and the circulating lines 50, and includes the particle size distribution measuring instrument and/or zeta potential measuring instrument 60 in the sampling circulating line 51. Also this method can prevent the generation of air bubbles.

The holding tank 40 of a material to be processed is adapted to be capable of being agitated by an agitator or the like as the need arises. Moreover, the holding tank 40 is adapted to be capable of being heated or cooled by means of a jacket or the like. It is preferable that the holding time of the holding tank 40 is adapted to be 1 minute or more to the flow rates in the circulating lines 50, and more preferably 3 minutes or more. If the holding time is 1 minute or less, then there is the possibility that the circulating lines 50 entrain air bubbles.

Figure 3:
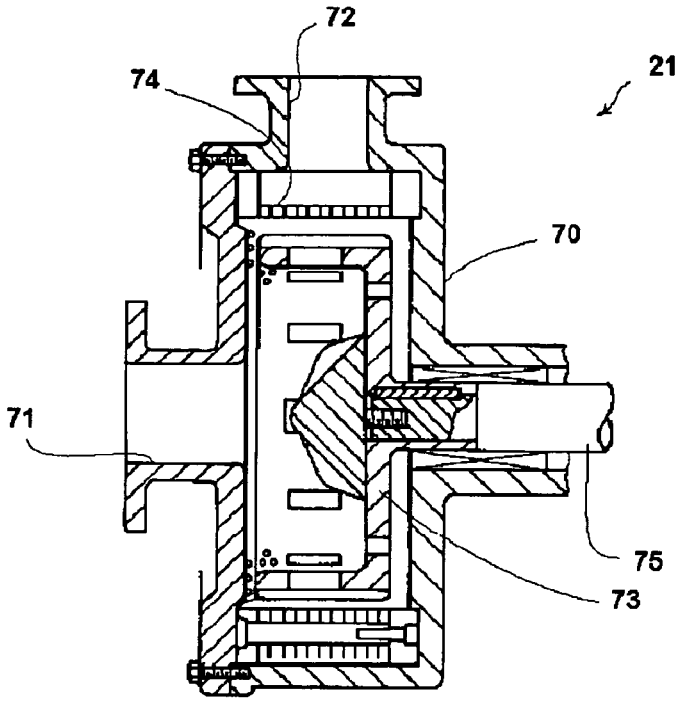
FIG. 3 is a schematic sectional view showing an example of a medium agitating type wet pulverization/dispersion machine used in the present invention.
Figure 4:
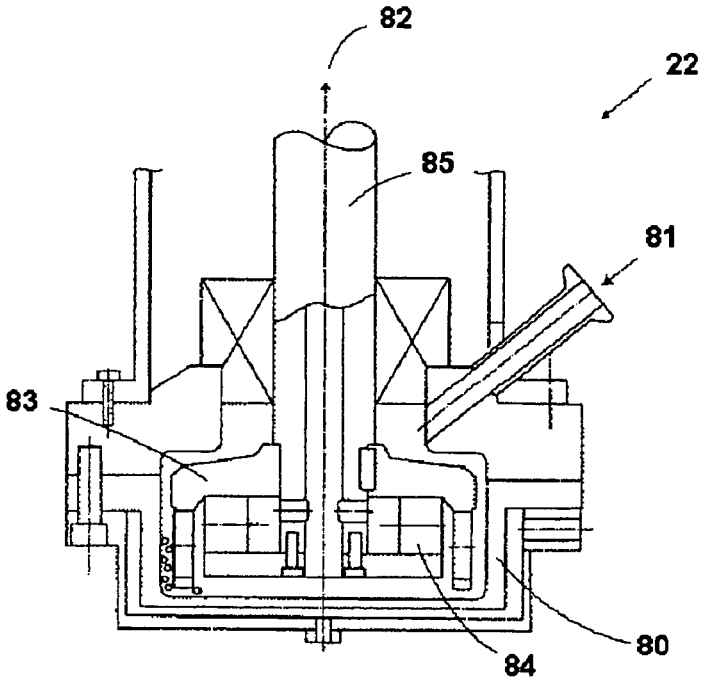
FIG. 4 is a schematic explanatory view showing another example of the medium agitating type wet pulverization/dispersion machine used in the present invention.

Although the type of the medium agitating type wet pulverization/dispersion machine 20 to be used is not especially limited, the medium agitating type wet pulverization/dispersion machine 20 is, for example, pulverization/dispersion machines shown in FIGS. 3 and 4. The medium agitating type wet pulverization/dispersion machine 21 shown in FIG. 3 is equipped with a rotation type agitating member 73 and a separator 74 in a cylindrical pulverization container 70 equipped with a supply port 71 and an exhaust port 72 of a material to be processed. The agitating member 73 is a rotor type one and rotates together with a driving shaft 75 in a body. The separator 74 is a cylindrical sieve type one, and is adapted to divide the inner part of the pulverization container 70 into two chambers on the inside and on the outside.

The medium agitating type wet pulverization/dispersion machine 22 shown in FIG. 4 is equipped with a rotation type agitating member 83 and a separator 84 in a cylindrical pulverization container 80 equipped with a supply port 81 of a material to be processed. The agitating member 83 is a rotor type one, and rotates together with a hollow driving shaft 85 in a body. The separator 84 is a centrifugal separator rotating together with the driving shaft 85, and the hollow portion of the driving shaft 85 forms an exhaust port 82. Any pulverization medium cannot enter the exhaust port 82 by the centrifugal force of the separator 84, and only the material to be processed flows toward the exhaust port 82.

The particle size distribution measuring instrument 60 is preferably the one performing measurement by means of an ultrasonic wave. As this method, an ultrasonic attenuation method and an electronkinetic sonic amplitude method are conceivable. Because both the methods are hard to influence by the concentration of particles, the measurement in a high concentration can be performed. By the ultrasonic attenuation method, when an ultrasonic wave has passed through slurry, the ultrasonic wave is attenuated according to the sizes of the particles and the concentration. Accordingly, the method is adapted to determine a particle size distribution by considering a viscosity loss, a thermal loss, and a scattering loss as the primary factors of the attenuation, and by analyzing these factors.

Moreover, the electronkinetic sonic amplitude method is the one using the fact that, when an alternating voltage is applied between the electrodes putting slurry between them, an ultrasonic wave is generated by the movements of particles. At this time, the method uses the fact that the phases of the movements of the particles delay to the phase of an electric field, and the fact that the delays become larger as the sizes of the particles become larger. Then, the method calculates the dynamic mobility of the particles to obtain the particle size distribution by measuring the intensity of the ultrasonic wave and the delays of the phases.

The particle size distribution measuring instrument performing measurement by means of the ultrasonic attenuation method or the electronkinetic sonic amplitude method can use the slurry of a high concentration as a measurement sample without diluting the slurry. With regard to the measurement range of the instrument 60, it is preferable to use the ultrasonic attenuation method when the particle diameters of the slurry are 0.1 μm or less, and it is preferable to use the electronkinetic sonic amplitude method when the particle diameters are larger than 0.1 μm. Incidentally, it is also possible to provide both the measuring methods of the ultrasonic attenuation method and the electronkinetic sonic amplitude method to one particle size distribution measuring instrument.

The electronkinetic sonic amplitude method can measure zeta potential at the same time. Because the zeta potential has strong correlativity with the particle size distribution, the zeta potential can be used as the means for judging the progress of pulverization processing. In order to improve the stability of the dispersion of slurry, it is necessary that the absolute value of the zeta potential exceeds 30 mV at the lowest.

Moreover, it is also possible to measure the particle size distribution and the zeta potential at the same time.

A check test was performed under the following conditions by means of the pulverization/dispersion processing system shown in FIG. 2.

Material to Be Processed: slurry of titanium oxide and water

Concentration: 10 wt %

Circulation Flow Rate: 0.15 L/min

Pulverizer: pulverization/dispersion machine (rotor diameter: 60 mm) shown in FIG. 4

Medium: zirconia of diameter of 0.03 mm

Throughput Rate: 0.5 L

Measuring Instrument Acousto Sizer IIM available from Bel Japan, Inc.

Figure 5:
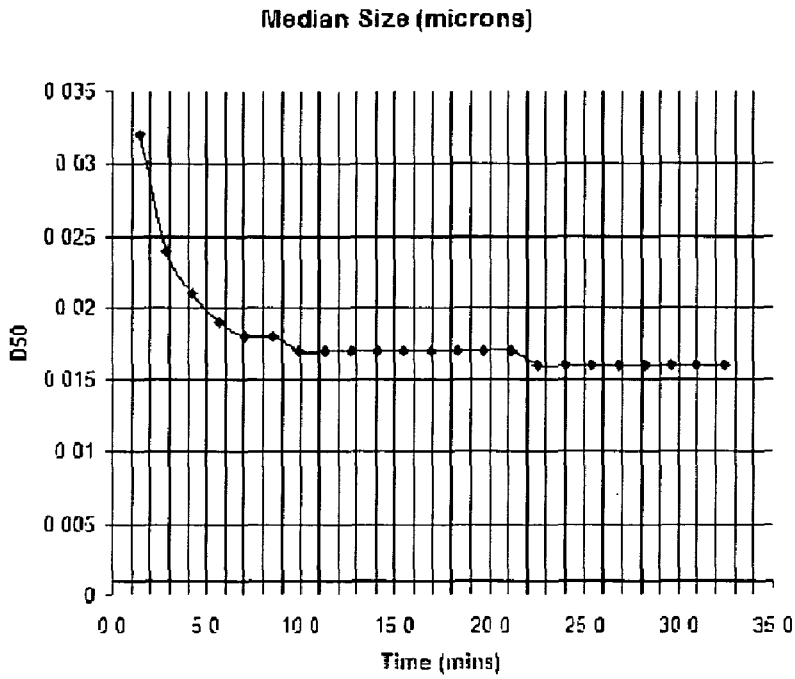
FIG. 5 is a graph showing a measurement result of a particle size distribution.
Figure 6:
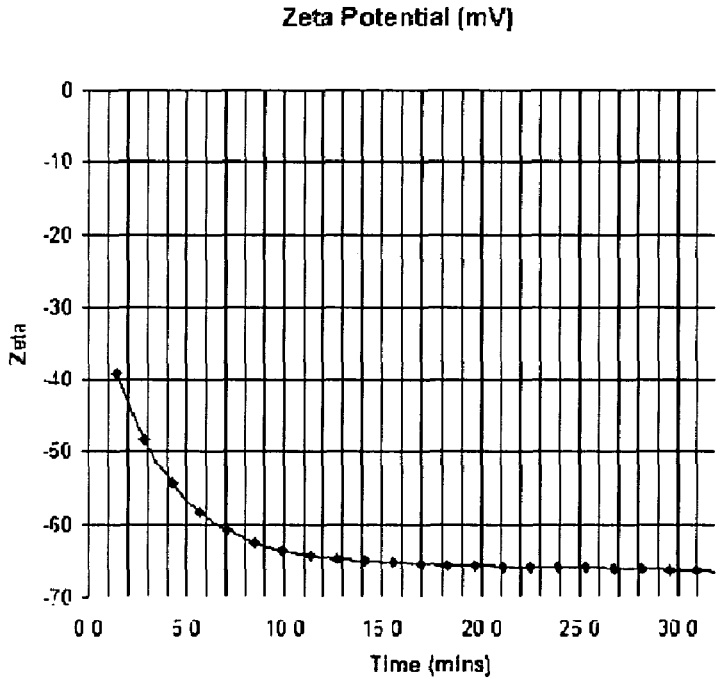
FIG. 6 is a graph showing measurement results of zeta potential.
Figure 7:
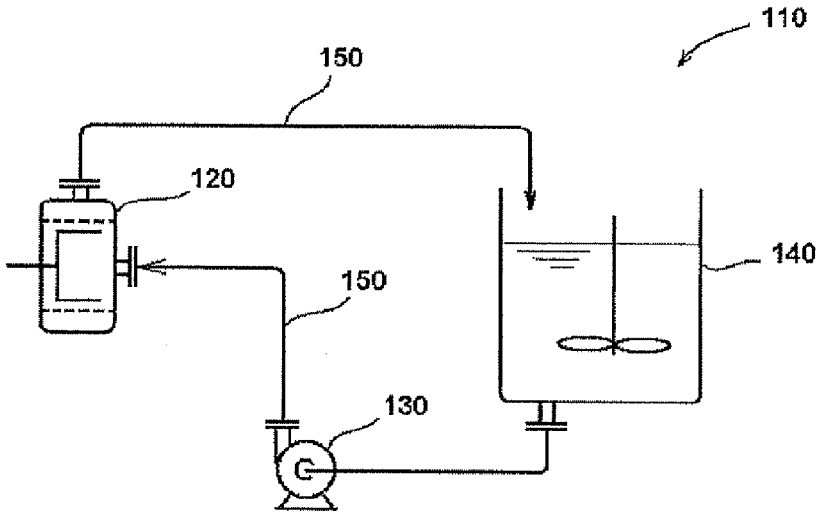
FIG. 7 is a schematic explanatory view showing a conventional pulverization processing system.

A particle size distribution and zeta potential obtained by the test as the results thereof are shown in FIG. 5 and FIG. 6, respectively. In both the figures, abscissa axes indicate processing times (minute), and ordinate axes indicate average particle diameters (μm) and zeta potential (mV), respectively. These results indicate that the pulverization/dispersion processing system of the present invention successively presents the progress of pulverization/dispersion processing in a short period.

The invention claimed is:

1. A pulverization/dispersion processing system including a medium agitating type wet pulverization/dispersion machine, a holding tank of a material to be processed, a circulating pump, and a circulating line connecting these components to each other, characterized by: a zeta potential measuring instrument in the circulating line on an entrance side of the medium agitating type wet pulverization/dispersion machine.

2. The pulverization/dispersion processing system according to claim 1, wherein the zeta potential measuring instrument performs measurement by means of an ultrasonic wave.

3. The pulverization/dispersion processing system according to claim 2, wherein the zeta potential measuring instrument performs the measurement by means of an electronkinetic sonic amplitude method.

4. A pulverization/dispersion processing system including a medium agitating type wet pulverization/dispersion machine, a holding tank of a material to be processed, a circulating pump, and a circulating line connecting these components to each other, characterized by: a sampling pump and a sampling circulating line apart from the circulating pump and the circulating line, wherein a zeta potential measuring instrument is provided in the sampling circulating line.

5. The pulverization/dispersion processing system according to claim 4, wherein the zeta potential measuring instrument performs measurement by means of an ultrasonic wave.

6. A pulverization/dispersion processing system including a medium agitating type wet pulverization/dispersion machine, a holding tank of a material to be processed, a circulating pump, and a circulating line connecting these components to each other, characterized by: a particle size distribution measuring instrument in the circulating line on an entrance side of the medium agitating type wet pulverization/dispersion machine.

7. The pulverization/dispersion processing system according to claim 6, wherein the particle size distribution measuring instrument performs measurement by means of an ultrasonic attenuation method.

8. The pulverization/dispersion processing system according to claim 6, wherein the particle size distribution measuring instrument performs measurement by means of an electronkinetic sonic amplitude method.

9. The pulverization/dispersion processing system according to claim 6, wherein the particle size distribution measuring instrument performs measurement by means of both of an ultrasonic attenuation method and an electronkinetic sonic amplitude method.

10. A pulverization/dispersion processing system including a medium agitating type wet pulverization/dispersion machine, a holding tank of a material to be processed, a circulating pump, and a circulating line connecting these components to each other, characterized by: a sampling pump and a sampling circulating line apart from the circulating pump and the circulating line, wherein a particle size distribution measuring instrument is provided in the sampling circulating line.

11. The pulverization/dispersion processing system according to claim 10, wherein the particle size distribution measuring instrument performs measurement by means of an ultrasonic attenuation method.

12. The pulverization/dispersion processing system according to claim 10, wherein the particle size distribution measuring instrument performs measurement by means of an electronkinetic sonic amplitude method.

13. The pulverization/dispersion processing system according to claim 10, wherein the particle size distribution measuring instrument performs measurement by means of both of an ultrasonic attenuation method and an electronkinetic sonic amplitude method.

* * * * *